US007407449B2

(12) United States Patent
Shindo et al.

(10) Patent No.: US 7,407,449 B2
(45) Date of Patent: Aug. 5, 2008

(54) GOLF BALL

(75) Inventors: Jun Shindo, Chichibu (JP); Eiji Takehana, Chichibu (JP); Kae Yamazaki, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 11/878,944

(22) Filed: Jul. 27, 2007

(65) Prior Publication Data

US 2008/0026874 A1 Jan. 31, 2008

Related U.S. Application Data

(63) Continuation-in-part of application No. 11/324,297, filed on Jan. 4, 2006, now Pat. No. 7,294,067.

(30) Foreign Application Priority Data

Jul. 2, 2007 (JP) ..... 2007-173995

(51) Int. Cl.
*A63B 37/00* (2006.01)

(52) U.S. Cl. ..... 473/351

(58) Field of Classification Search ..... 473/351, 473/373, 374, 377
See application file for complete search history.

(56) References Cited

U.S. PATENT DOCUMENTS

| | | | | |
|---|---|---|---|---|
| 6,184,276 | B1 | 2/2001 | Ignatz-Hoover | |
| 6,194,505 | B1 | 2/2001 | Sone et al. | |
| 6,277,924 | B1 | 8/2001 | Hamada et al. | |
| 6,372,847 | B1 | 4/2002 | Wouters | |
| 6,596,801 | B2 | 7/2003 | Higuchi et al. | |
| 6,602,941 | B2 | 8/2003 | Higuchi et al. | |
| 6,634,961 | B2 | 10/2003 | Higuchi et al. | |
| 6,695,716 | B2 | 2/2004 | Higuchi et al. | |
| 6,712,715 | B2 | 3/2004 | Higuchi et al. | |
| 6,786,836 | B2 | 9/2004 | Higuchi et al. | |
| 6,795,172 | B2 | 9/2004 | Putman et al. | |
| 6,818,705 | B2 | 11/2004 | Wu et al. | |
| 6,841,642 | B2 | 1/2005 | Kaszas | |
| 6,921,345 | B2 | 7/2005 | Higuchi et al. | |
| 6,923,735 | B1 | 8/2005 | Hayashi | |
| 7,250,010 | B1 * | 7/2007 | Shindo et al. | 473/351 |
| 7,294,067 | B2 * | 11/2007 | Shindo et al. | 473/351 |
| 2004/0147694 | A1 | 7/2004 | Sone et al. | |
| 2005/0148723 | A1 | 7/2005 | Kondou | |

FOREIGN PATENT DOCUMENTS

| | | | |
|---|---|---|---|
| JP | 7-268132 | A | 10/1995 |
| JP | 11-35633 | A | 2/1999 |
| JP | 2002-355336 | A | 12/2002 |
| JP | 2002-355337 | A | 12/2002 |
| JP | 2002-355338 | A | 12/2002 |
| JP | 2002-355339 | A | 12/2002 |
| JP | 2002-355340 | A | 12/2002 |
| JP | 2002-356581 | A | 12/2002 |
| JP | 2004-292667 | A | 10/2004 |
| WO | WO 2003/082925 | | 10/2003 |

OTHER PUBLICATIONS

"Report of Research & Development", Fine Chemical, vol. 23, No. 9, p. 5-15 (1994).
"Hydrolysis of Tri-tert-butylaluminum" by Mason et al., J. American Chemical Society, vol. 115, pp. 4971-4984 (1993).
"Three-Coordinate Aluminum Is Not a Prerequisite for Catalytic Activity in the Zirconocene-Alumoxane Polymerization of Ethylene", by Harlen et al, J. American Chemical Society, vol. 117, pp. 6465-6474, (1995).

* cited by examiner

*Primary Examiner*—Raeann Trimiew
(74) *Attorney, Agent, or Firm*—Sughrue Mion, PLLC

(57) ABSTRACT

The present invention provides a golf ball having a core, an outermost cover layer and an intermediate layer therebetween. The core is made of a material obtained by molding under heat a rubber composition containing polybutadiene having a stress relaxation time ($T_{80}$) of 3.5 or less. The intermediate layer, which is of a specific thickness, is made primarily of a resin material of a specific hardness obtained by blending together (I) a sodium ion neutralization product of an olefin-unsaturated carboxylic acid random copolymer with (II) a magnesium ion neutralization product of an olefin-unsaturated carboxylic acid random copolymer. The outermost cover layer, which is of a specific thickness, is made primarily of a non-ionomeric resin material of a specific hardness. The golf ball has an excellent rebound, a good feel on impact, and an excellent scuff resistance.

7 Claims, No Drawings

GOLF BALL

CROSS-REFERENCE TO RELATED APPLICATION

This application is a continuation-in-part of copending application Ser. No. 11/324,297 filed on Jan. 4, 2006, the entire contents of which are hereby incorporated by reference.

This application claims priority under 35 U.S.C. §119(a) on Patent Application No. 2007-173995 filed in Japan on Jul. 2, 2007, the entire contents of which are hereby incorporated by reference.

BACKGROUND OF THE INVENTION

The present invention relates to a golf ball having an excellent rebound.

Efforts to confer golf balls with an excellent rebound have until now focused on and attempted to optimize one or more indicator of the polybutadiene used as the base rubber, such as the Mooney viscosity, polymerization catalyst, solvent viscosity and molecular weight distribution. See, for example, Patent Document 1: JP-A 2004-292667; Patent Document 2: U.S. Pat. No. 6,818,705; Patent Document 3: JP-A 2002-355336; Patent Document 4: JP-A 2002-355337; Patent Document 5: JP-A 2002-355338; Patent Document 6: JP-A 2002-355339; Patent Document 7: JP-A 2002-355340; and Patent Document 8: JP-A 2002-356581.

For example, Patent Document 1 (JP-A 2004-292667) describes, as a base rubber for golf balls, a polybutadiene having a Mooney viscosity of 30 to 42 and a molecular weight distribution (Mw/Mn) of 2.5 to 3.8. Patent Document 2 (U.S. Pat. No. 6,818,705) describes, for the same purpose, a polybutadiene having a molecular weight of at least 200,000 and a resilience index of at least 40.

However, because many golfers desire golf balls capable of traveling a longer distance, there exists a need for the development of golf balls having an even better rebound.

Patent Document 1: JP-A 2004-292667
Patent Document 2: U.S. Pat. No. 6,818,705
Patent Document 3: JP-A 2002-355336
Patent Document 4: JP-A 2002-355337
Patent Document 5: JP-A 2002-355338
Patent Document 6: JP-A 2002-355339
Patent Document 7: JP-A 2002-355340
Patent Document 8: JP-A 2002-356581

SUMMARY OF THE INVENTION

It is therefore an object of the present invention to provide a golf ball having an excellent rebound.

As a result of extensive investigations, the inventor has discovered that, in a golf ball composed of a core, an outermost cover layer and an intermediate layer therebetween, a good ball rebound is maintained by forming the core of a material obtained by molding under heat a rubber composition which includes a base rubber containing a polybutadiene having a specific $T_{80}$ value, an unsaturated carboxylic acid and/or a metal salt thereof, and an organic peroxide; by forming the intermediate layer primarily of a resin material obtained by blending together (I) a sodium ion neutralization product of an olefin-unsaturated carboxylic acid random copolymer with (II) a magnesium ion neutralization product of an olefin-unsaturated carboxylic acid random copolymer, setting the intermediate layer-forming resin material to a Shore D hardness of from 55 to 70 and setting the intermediate layer to a thickness of from 0.5 to 2.5 mm; and by forming the outermost cover layer primarily of a non-ionomeric resin material, setting the cover-forming resin material to a Shore D hardness of from 35 to 60 and setting the cover to a thickness of from 0.5 to 2.0 mm. In addition, the golf ball of the invention has been found to have a flight performance and controllability acceptable for use by professionals and skilled amateur golfers, and to have also a good feel on impact and an excellent scuff resistance.

Accordingly, the invention provides the following golf ball.

[1] A golf ball comprising a core, an outermost cover layer and an intermediate layer therebetween, wherein the core is made of a material obtained by molding under heat a rubber composition comprising (a) a base rubber containing polybutadiene having a stress relaxation time ($T_{80}$), defined as the time in seconds from the moment when rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of 3.5 or less, (b) an unsaturated carboxylic acid and/or a metal salt thereof, and (c) an organic peroxide; the intermediate layer has a thickness of from 0.5 to 2.5 mm and is made primarily of a resin material obtained by blending together (I) a sodium ion neutralization product of an olefin-unsaturated carboxylic acid random copolymer with (II) a magnesium ion neutralization product of an olefin-unsaturated carboxylic acid random copolymer and having a Shore D hardness of from 55 to 70; and the outermost cover layer has a thickness of from 0.5 to 2.0 mm and is made primarily of a non-ionomeric resin material having a Shore D hardness of from 35 to 60.

[2] The golf ball of [1], wherein the rubber composition further comprises (d) an organosulfur compound.

[3] The golf ball of [1], wherein the polybutadiene having a stress relaxation time ($T_{80}$) of 3.5 or less accounts for at least 40 wt % of the base rubber.

[4] The golf ball of [1], wherein the polybutadiene having a stress relaxation time ($T_{80}$) of 3.5 or less is a polybutadiene prepared using a rare-earth catalyst.

[5] The golf ball of [1], wherein the polybutadiene having a stress relaxation time ($T_{80}$) of 3.5 or less is a polybutadiene prepared by polymerization using a rare-earth catalyst, followed by terminal modification.

[6] The golf ball of [1], wherein the intermediate layer-forming material contains material (I) and material (II) in a mixing ratio by weight of from 20/80 to 80/20.

[7] The golf ball of [1], wherein the non-ionomeric resin material in the outermost cover layer is a thermoplastic polyurethane elastomer.

DETAILED DESCRIPTION OF THE INVENTION

The invention is described more fully below.

The golf ball of the invention has a multilayer structure composed of a core and a plurality of cover layers which enclose the core. The enclosing layers outside of the core include at least an outermost cover layer and an intermediate layer. The core is made of a material obtained by molding under heat a rubber composition which includes the following components (a) to (c):

(a) a base rubber containing polybutadiene having a stress relaxation time ($T_{80}$), as defined below, of 3.5 or less, (b) an unsaturated carboxylic acid and/or a metal salt thereof, and (c) an organic peroxide.

The stress relaxation time ($T_{80}$) is the time in seconds, from the moment when rotor rotation is stopped immediately after measurement of the $ML_{1+4}$ (100° C.) value (the Mooney viscosity measured at 100° C. in accordance with ASTM D-1646-96), that is required for the $ML_{1+4}$ value to decrease 80%.

The term "Mooney viscosity" used herein refers to an industrial indicator of viscosity as measured with a Mooney viscometer, which is a type of rotary plastometer. The unit symbol used is $ML_{1+4}$ (100° C.), where "M" stands for Mooney viscosity, "L" stands for large rotor (L-type), "1+4" stands for a pre-heating time of 1 minute and a rotor rotation time of 4 minutes, and "100° C." indicates that measurement was carried out at a temperature of 100° C.

In the practice of the invention, the polybutadiene in above component (a) includes a polybutadiene having a stress relaxation time ($T_{80}$) of 3.5 or less (which polybutadiene is sometimes abbreviated below as "BR1"). The $T_{80}$ value is preferably 3.0 or less, more preferably 2.8 or less, and even more preferably 2.5 or less. The $T_{80}$ value has a lower limit of preferably 1 or more, and more preferably 1.5 or more. At a $T_{80}$ value of more than 3.5, the objects of the invention cannot be attained. On the other hand, if the $T_{80}$ value is too small, problems may arise with workability.

The foregoing polybutadiene BR1 has a Mooney viscosity ($ML_{1+4}$ (100° C.)) which, while not subject to any particular limitation, is preferably at least 20 but not more than 80.

It is recommended that the above polybutadiene BR1 have a cis-1,4 bond content of preferably 60%, more preferably at least 80%, even more preferably at least 90%, and most preferably at least 95%, and a 1,2-vinyl bond content of preferably at most 2%, more preferably at most 1.7%, even more preferably at most 1.5%, and most preferably at most 1.3%. At a cis-1,4 bond content or a 1,2-vinyl bond content outside of these ranges, the rebound may decrease.

From the standpoint of rebound, it is preferable for the above polybutadiene BR1 used in the invention to be a polybutadiene synthesized using a rare-earth catalyst.

A known rare-earth catalyst may be used for this purpose. Exemplary rare-earth catalysts include those made up of a combination of a lanthanide series rare-earth compound, an organoaluminum compound, an alumoxane, a halogen-bearing compound, and an optional Lewis base.

Examples of suitable lanthanide series rare-earth compounds include halides, carboxylates, alcoholates, thioalcoholates and amides of atomic number 57 to 71 metals.

Organoaluminum compounds that may be used include those of the formula $AlR^1R^2R^3$ (wherein $R^1$, $R^2$ and $R^3$ are each independently a hydrogen or a hydrocarbon group of 1 to 8 carbons).

Preferred alumoxanes include compounds of the structures shown in formulas (I) and (II) below. The alumoxane association complexes described in *Fine Chemical* 23, No. 9, 5 (1994), *J. Am. Chem. Soc.* 115, 4971 (1993), and *J. Am. Chem. Soc.* 117, 6465 (1995) are also acceptable.

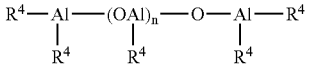

(I)

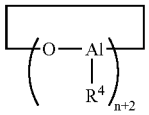

(II)

In the above formulas, $R^4$ is a hydrocarbon group having 1 to 20 carbon atoms, and n is 2 or a larger integer.

Examples of halogen-bearing compounds that may be used include aluminum halides of the formula $AlX_nR_{3-n}$ (wherein X is a halogen; R is a hydrocarbon group of 1 to 20 carbons, such as an alkyl, aryl or aralkyl; and n is 1, 1.5, 2 or 3); strontium halides such as $Me_3SrCl$, $Me_2SrCl_2$, $MeSrHCl_2$ and $MeSrCl_3$; and other metal halides such as silicon tetrachloride, tin tetrachloride and titanium tetrachloride.

The Lewis base can be used to form a complex with the lanthanide series rare-earth compound. Illustrative examples include acetylacetone and ketone alcohols.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Preferred examples of such rare-earth catalysts include those mentioned in JP-A 11-35633.

The polymerization of butadiene in the presence of a rare-earth catalyst may be carried out by bulk polymerization or vapor phase polymerization, either with or without the use of solvent, and at a polymerization temperature in a range of preferably from −30 to +150° C., and more preferably from 10 to 100° C.

To manufacture golf balls of stable quality, it is desirable for the above-described polybutadiene BR1 used in the invention to be a terminal-modified polybutadiene obtained by polymerization using the above-described rare-earth catalyst, followed by the reaction of a terminal modifier with active end groups on the polymer.

A known terminal modifier may be used for this purpose. Illustrative examples include compounds of types (1) to (6) below.

(1) Halogenated organometallic compounds, halogenated metallic compounds and organometallic compounds of the general formulas $R^5_nM'X_{4-n}$, $M'X_4$, $M'X_3$, $R^5_nM'(-R^6—COOR^7)_{4-n}$ or $R^5_nM'(-R^6—COR^7)_{4-n}$ (wherein $R^5$ and $R^6$ are each independently a hydrocarbon group of 1 to 20 carbons; $R^7$ is a hydrocarbon group of 1 to 20 carbons which may contain pendant carbonyl or ester groups; M' is a tin, silicon, germanium or phosphorus atom; X is a halogen atom; and n is an integer from 0 to 3);

(2) heterocumulene compounds having on the molecule a Y═C═Z linkage (wherein Y is a carbon, oxygen, nitrogen or sulfur atom; and Z is an oxygen, nitrogen or sulfur atom);

(3) three-membered heterocyclic compounds containing on the molecule the following bonds

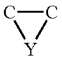

(wherein Y is an oxygen, nitrogen or sulfur atom);

(4) halogenated isocyano compounds;

(5) carboxylic acids, acid halides, ester compounds, carbonate compounds and acid anhydrides of the formula $R^8—(COOH)_m$, $R^9(COX)_m$, $R^{10}—(COO—R^{11})$, $R^{12}—OCOO—R^{13}$, $R^{14}—(COOCO—R^{15})_m$ or

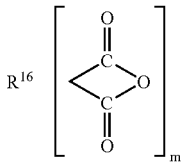

(wherein $R^8$ to $R^{16}$ are each independently a hydrocarbon group of 1 to 50 carbons, X is a halogen atom, and m is an integer from 1 to 5); and (6) carboxylic acid metal salts of the formula $R^{17}{}_1M''(OCOR^{18})_{4-1}$, $R^{19}{}_1M''(OCO—R^{20}—COOR^{21})_{4-1}$ or

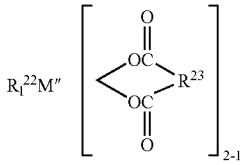

(wherein $R^{17}$ to $R^{23}$ are independently a hydrocarbon group of 1 to 20 carbons, M" is a tin, silicon or germanium atom, and the letter l is an integer from 0 to 3).

Specific examples of the above terminal modifiers (1) to (6) and methods for their reaction are described in, for example, JP-A 11-35633 and JP 7-268132.

In the practice of the invention, the above-described polybutadiene BR1 is included within the base rubber and accounts for preferably at least 40 wt %, more preferably at least 50 wt %, even more preferably at least 60 wt %, and even up to 100 wt %, of the base rubber. If this proportion is too low, the rebound may decrease.

No particular limitation is imposed on rubber compounds other than BR1 which may be included in the base rubber. For example, polybutadiene rubbers having a stress relaxation time $T_{80}$ of more than 3.5 may be included, as can also other rubber compounds such as styrene-butadiene rubbers (SBR), natural rubbers, polyisoprene rubbers and ethylene-propylene-diene rubbers (EPDM). These may be used individually or as combinations of two or more thereof.

The Mooney viscosity of such additional rubbers included in the base rubber, while not subject to any particular limitation, is preferably at least 20 but preferably not more than 80.

Rubbers synthesized with a group VIII catalyst may be used as such additional rubbers included in the base rubber. Exemplary group VIII catalysts include the following nickel catalysts and cobalt catalysts.

Examples of suitable nickel catalysts include single-component systems such as nickel-kieselguhr, binary systems such as Raney nickel/titanium tetrachloride, and ternary systems such as nickel compound/organometallic compound/boron trifluoride etherate. Exemplary nickel compounds include reduced nickel on a carrier, Raney nickel, nickel oxide, nickel carboxylate and organonickel complex salts. Exemplary organometallic compounds include trialkylaluminum compounds such as triethylaluminum, tri-n-propylaluminum, triisobutylaluminum and tri-n-hexylaluminum; alkyllithium compounds such as n-butyllithium, sec-butyllithium, tert-butyllithium and 1,4-dilithiumbutane; and dialkylzinc compounds such as diethylzinc and dibutylzinc.

Examples of suitable cobalt catalysts include cobalt and cobalt compounds such as Raney cobalt, cobalt chloride, cobalt bromide, cobalt iodide, cobalt oxide, cobalt sulfate, cobalt carbonate, cobalt phosphate, cobalt phthalate, cobalt carbonyl, cobalt acetylacetonate, cobalt diethyldithiocarbamate, cobalt anilinium nitrite and cobalt dinitrosyl chloride. It is particularly advantageous to use these compounds in combination with, for example, a dialkylaluminum monochloride such as diethylaluminum monochloride or diisobutylaluminum monochloride; a trialkylaluminum such as triethylaluminum, tri-n-propylaluminum, triisobutylaluminum or tri-n-hexylaluminum; an alkylaluminum sesquichloride such as ethylaluminum sesquichloride; or aluminum chloride.

Polymerization using the above group VIII catalysts, and particularly a nickel or cobalt catalyst, can be carried out by a process in which, typically, the catalyst is continuously charged into a reactor together with a solvent and butadiene monomer, and the reaction conditions are suitably selected, such as a reaction temperature in a range of 5 to 60° C. and a reaction pressure in a range of atmospheric pressure to 70 plus atmospheres, so as to yield a product having the above-indicated Mooney viscosity.

Above component (b) may be an unsaturated carboxylic acid, specific examples of which include acrylic acid, methacrylic acid, maleic acid and fumaric acid. Acrylic acid and methacrylic acid are especially preferred. Alternatively, it may be the metal salt of an unsaturated carboxylic acid, examples of which include the zinc and magnesium salts of unsaturated fatty acids such as zinc dimethacrylate and zinc diacrylate. The use of zinc diacrylate is especially preferred.

It is recommended that the content of above component (b) per 100 parts by weight of the base rubber be preferably at least 10 parts by weight, and more preferably at least 15 parts by weight, but preferably not more than 60 parts by weight, more preferably not more than 50 parts by weight, even more preferably not more than 45 parts by weight, and most preferably not more than 40 parts by weight. Too much component (b) will make the material molded under heat from the rubber composition too hard, giving the golf ball an unpleasant feel on impact. On the other hand, too little will result in a lower rebound.

Above component (c) may be a commercially available product, suitable examples of which include Percumyl D (produced by NOF Corporation), Perhexa 3C (NOF Corporation) and Luperco 231XL (Atochem Co.). If necessary, a combination of two or more different organic peroxides may be used.

It is recommended that the amount of component (c) per 100 parts by weight of the base rubber be preferably at least 0.1 part by weight, and more preferably at least 0.3 part by weight, but preferably not more than 5 parts by weight, more preferably not more than 4 parts by weight, even more preferably not more than 3 parts by weight, and most preferably not more than 2 parts by weight. Too much or too little component (c) may make it impossible to obtain a suitable hardness distribution, resulting in a poor feel on impact, durability and rebound.

To further improve rebound, it is desirable for the rubber composition in the invention to include also the following component (d):

(d) an organosulfur compound.

Examples of such organosulfur compounds include thiophenols, thionaphthols, halogenated thiophenols, and metal salts thereof. Specific examples include the zinc salts of pentachlorothiophenol, pentafluorothiophenol, pentabromothiophenol and p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. These may be used singly or as combinations of two or more thereof. Diphenyldisulfide and/or the zinc salt of pentachlorothiophenol are especially preferred.

It is recommended that the amount of component (d) included per 100 parts by weight of the base rubber be preferably at least 0.1 part by weight, more preferably at least 0.2 part by weight, and even more preferably at least 0.5 part by weight, but preferably not more than 5 parts by weight, more preferably not more than 4 parts by weight, and even more preferably not more than 3 parts by weight. Too much organosulfur compound may make the material molded under heat from the rubber composition too soft, whereas too little may make an improved rebound difficult to achieve.

The rubber composition in the invention may additionally include such additives as inorganic fillers and antioxidants. Illustrative examples of suitable inorganic fillers include zinc oxide, barium sulfate and calcium carbonate. The amount included per 100 parts by weight of the base rubber is preferably at least 5 parts by weight, more preferably at least 7 parts by weight, even more preferably at least 10 parts by weight, and most preferably at least 13 parts by weight, but preferably not more than 80 parts by weight, more preferably not more than 50 parts by weight, even more preferably not more than 45 parts by weight, and most preferably not more than 40 parts by weight. Too much or too little inorganic filler may make it impossible to obtain a proper golf ball weight and a suitable rebound.

To increase the rebound, it is desirable for the inorganic filler to include zinc oxide in an amount of at least 50 wt %, preferably at least 75 wt %, and most preferably 100 wt % (where the zinc oxide accounts for 100% of the inorganic filler).

The zinc oxide has an average particle size (by air permeametry) of preferably at least 0.01 μm, more preferably at least 0.05 μm, and most preferably at least 0.1 μm, but preferably not more than 2 μm, and more preferably not more than 1 μm.

Examples of suitable commercial antioxidants include 2,2'-methylenebis(4-methyl-6-t-butylphenol) (Nocrac NS-6, available from Ouchi Shinko Chemical Industry Co., Ltd.) and 2,2'-methylenebis(4-ethyl-6-t-butylphenol) (Nocrac NS-5, Ouchi Shinko Chemical Industry Co., Ltd.). To achieve a good rebound and durability, it is recommended that the amount of antioxidant included per 100 parts by weight of the base rubber be preferably more than 0 part by weight, more preferably at least 0.05 part by weight, even more preferably at least 0.1 part by weight, and most preferably at least 0.2 part by weight, but preferably not more than 3 parts by weight, more preferably not more than 2 parts by weight, even more preferably not more than 1 part by weight, and most preferably not more than 0.5 part by weight.

The core in the present invention can be obtained by vulcanizing and curing the rubber composition using a method of the same sort as that used on prior-art rubber compositions for golf balls. Vulcanization may be carried, for example, at a temperature of from 100 to 200° C. for a period of 10 to 40 minutes.

It is recommended that the core (hot-molded material) in the invention have a hardness difference, obtained by subtracting the JIS-C hardness at the center of the hot-molded material from the JIS-C hardness at the surface of the material, of preferably at least 15, more preferably at least 16, even more preferably at least 17, and most preferably at least 18, but preferably not more than 50, and more preferably not more than 40. Setting the hardness within this range is desirable for achieving a golf ball having a soft feel and a good rebound and durability.

It is also recommended that the core (hot-molded material) in the invention have a deflection, when compressed under a final load of 1275 N (130 kgf) from an initial load of 98 N (10 kgf), of preferably at least 2.0 mm, more preferably at least 2.5 mm, and even more preferably at least 2.8 mm, but preferably not more than 6.0 mm, more preferably not more than 5.5 mm, even more preferably not more than 5.0 mm, and most preferably not more than 4.5 mm. Too small a deflection may worsen the feel of the ball on impact and, particularly on long shots such as with a driver in which the ball incurs a large deformation, may subject the ball to an excessive rise in spin, shortening the distance traveled by the ball. On the other hand, a hot-molded material that is too soft may deaden the feel of the golf ball when played and compromise the rebound of the ball, resulting in a shorter distance, and may give the ball a poor durability to cracking with repeated impact.

It is recommended that the core have a diameter of preferably at least 30.0 mm, more preferably at least 32.0 mm, even more preferably at least 35.0 mm, and most preferably at least 37.0 mm, but preferably not more than 41.0 mm, more preferably not more than 40.5 mm, even more preferably not more than 40.0 mm, and most preferably not more than 39.5 mm.

It is recommended that such a solid core in a solid three-piece golf ball have a diameter of preferably at least 30.0 mm, more preferably at least 32.0 mm, even more preferably at least 34.0 mm, and most preferably at least 35.0 mm, but preferably not more than 40.0 mm, more preferably not more than 39.5 mm, and even more preferably not more than 39.0 mm.

It is also recommended that the core have a specific gravity of preferably at least 0.9, more preferably at least 1.0, and even more preferably at least 1.1, but preferably not more than 1.4, more preferably not more than 1.3, and even more preferably not more than 1.2.

Next, in the present invention, the core is enclosed by a plurality of layers which include at least an intermediate layer and an outermost layer. The outermost cover layer is described below.

In the present invention, the outermost cover layer is formed primarily of a non-ionomeric resin. The non-ionomeric material is preferably a thermoplastic resin selected from among polyester elastomers, polyamide elastomers, polyurethane elastomers and mixtures thereof. A polyurethane elastomer is most preferred.

The polyurethane elastomer used as the outermost cover layer material is not subject to any particular limitation, although the use of a thermoplastic polyurethane is preferable in terms of amenability to mass production. In the present invention, it is preferable to use a cover molding material (C) composed primarily of the following components A and B:

(A) a thermoplastic polyurethane material; and (B) an isocyanate mixture of (b-1) an isocyanate compound having at least two isocyanate groups as functional groups per molecule, dispersed in (b-2) a thermoplastic resin which is substantially non-reactive with isocyanate.

In the practice of the invention, when the outermost cover layer is made of the above cover molding material (C), a golf ball having a better feel, controllability, cut resistance and scuff resistance can be obtained.

Components A, B and C are described below.

(A) Thermoplastic Polyurethane Material

The thermoplastic polyurethane material has a morphology which includes soft segments composed of a polymeric polyol (polymeric glycol) and hard segments composed of a chain extender and a diisocyanate. The polymeric polyol used as a starting material may be any that has hitherto been employed in the art relating to thermoplastic polyurethane materials, without particular limitation. Exemplary polymeric polyols include polyester polyols and polyether polyols, although polyether polyols are better than polyester polyols for synthesizing thermoplastic polyurethane materials that provide a high rebound resilience and have excellent low-temperature properties. Suitable polyether polyols include polytetramethylene glycol and polypropylene glycol. Polytetramethylene glycol is especially preferred for achieving a good rebound resilience and good low-temperature properties. The polymeric polyol has an average molecular weight of preferably 1,000 to 5,000. To synthesize a thermoplastic polyurethane material having a high rebound resilience, an average molecular weight of 2,000 to 4,000 is especially preferred.

Preferred chain extenders include those used in the prior art relating to thermoplastic polyurethane materials. Illustrative, non-limiting, examples include 1,4-butylene glycol, 1,2-ethylene glycol, 1,3-butanediol, 1,6-hexanediol, and 2,2-dimethyl-1,3-propanediol. These chain extenders have an average molecular weight of preferably 20 to 15,000.

Diisocyanates suitable for use include those employed in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. Depending on the type of isocyanate used, the crosslinking reaction during injection molding may be difficult to control. In the present invention, to ensure stable reactivity with the subsequently described isocyanate mixture (B), it is most preferable to use 4,4'-diphenylmethane diisocyanate.

A commercial product may be suitably used as the above-described thermoplastic polyurethane material. Illustrative examples include Pandex T-8290, Pandex T-8295 and Pandex T-8260 (all manufactured by DIC Bayer Polymer, Ltd.), and Resamine 2593 and Resamine 2597 (both manufactured by Dainichi Seika Colour & Chemicals Mfg. Co., Ltd.).

(B) Isocyanate Mixture

The isocyanate mixture (B) is prepared by dispersing (b-1) an isocyanate compound having as functional groups at least two isocyanate groups per molecule in (b-2) a thermoplastic resin that is substantially non-reactive with isocyanate. Above isocyanate compound (b-1) is preferably an isocyanate compound used in the prior art relating to thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. From the standpoint of reactivity and work safety, the use of 4,4'-diphenylmethane diisocyanate is most preferred.

The thermoplastic resin (b-2) is preferably a resin having a low water absorption and excellent compatibility with thermoplastic polyurethane materials. Illustrative, non-limiting, examples of such resins include polystyrene resins, polyvinyl chloride resins, ABS resins, polycarbonate resins and polyester elastomers (e.g., polyether-ester block copolymers, polyester-ester block copolymers). From the standpoint of rebound resilience and strength, the use of a polyester elastomer, particularly a polyether-ester block copolymer, is especially preferred.

In the isocyanate mixture (B), it is desirable for the relative proportions of the thermoplastic resin (b-2) and the isocyanate compound (b-1), expressed as the weight ratio (b-2):(b-1), to be preferably from 100:5 to 100:100, and more preferably from 100:10 to 100:40. If the amount of the isocyanate compound (b-1) relative to the thermoplastic resin (b-2) is too small, a greater amount of the isocyanate mixture (B) will have to be added to achieve an amount of addition sufficient for the crosslinking reaction with the thermoplastic polyurethane material (A). As a result, the thermoplastic resin (b-2) will exert a large influence, compromising the physical properties of the cover-molding material (C). On the other hand, if the amount of the isocyanate compound (b-1) relative to the thermoplastic resin (b-2) is too large, the isocyanate compound (b-1) may cause slippage to occur during mixing, making preparation of the isocyanate mixture (B) difficult.

The isocyanate mixture (B) can be obtained by, for example, adding the isocyanate compound (b-1) to the thermoplastic resin (b-2) and thoroughly working together these components at a temperature of 130 to 250° C. using mixing rolls or a Banbury mixer, then pelletizing or cooling and subsequently grinding. A commercial product such as Crossnate EM30 (made by Dainichi Seika Colour & Chemicals Mfg. Co., Ltd.) may be suitably used as the isocyanate mixture (B).

(C) Cover-Molding Material

The cover-molding material (C) is composed primarily of the above-described thermoplastic polyurethane material (A) and isocyanate mixture (B). The relative proportion of the thermoplastic polyurethane material (A) to the isocyanate mixture (B) in the cover-molding material (C), expressed as the weight ratio (A):(B), is preferably from 100:1 to 100:100, more preferably from 100:5 to 100:50, and even more preferably from 100:10 to 100:30. If too little isocyanate mixture (B) is included with respect to the thermoplastic polyurethane material (A), a sufficient crosslinking effect will not be achieved. On the other hand, if too much is included, unreacted isocyanate may discolor the molded material.

In addition to the above-described ingredients, other ingredients may be included in the cover-molding material (C). For example, thermoplastic polymeric materials other than the thermoplastic polyurethane material may be included; illustrative examples include polyester elastomers, polyamide elastomers, ionomer resins, styrene block elastomers, polyethylene and nylon resins. Thermoplastic polymeric materials other than the thermoplastic polyurethane material may be included in an amount of 0 to 100 parts by weight, preferably 10 to 75 parts by weight, and more preferably 10 to 50 parts by weight, per 100 parts by weight of the thermoplastic polyurethane material serving as the essential component. The amount of such thermoplastic polymeric materials used is selected as appropriate for such purposes as adjusting the hardness of the cover material, improving the rebound, improving the flow properties, and improving adhesion. If necessary, various additives such as pigments, dispersants, antioxidants, light stabilizers, ultraviolet absorbers and parting agents may also be suitably included in the cover-molding material (C).

Formation of the cover from the cover-molding material (C) can be carried out by adding the isocyanate mixture (B) to the thermoplastic polyurethane material (A) and dry mixing, then using an injection molding machine to mold the mixture into a cover over the core. The molding temperature varies with the type of thermoplastic polyurethane material (A), although molding is generally carried out within a temperature range of 150 to 250° C.

Reactions and crosslinking which take place in the golf ball cover obtained as described above are believed to involve the reaction of isocyanate groups with hydroxyl groups remaining in the thermoplastic polyurethane material to form urethane bonds, or the creation of an allophanate or biuret crosslinked form via a reaction involving the addition of isocyanate groups to urethane groups in the thermoplastic polyurethane material. Although the crosslinking reaction has not yet proceeded to a sufficient degree immediately after injection molding of the cover-molding material (C), the crosslinking reaction can be made to proceed further by carrying out an annealing step after molding, in this way conferring the golf ball cover with useful characteristics. "Annealing," as used herein, refers to heat aging the cover at a constant temperature for a given length of time, or aging the cover for a fixed period at room temperature.

In addition to the above resin components, various optional additives may be included in the above-described resin material for the outermost cover layer. Such additives include, for example, pigments, dispersants, antioxidants, ultraviolet absorbers, ultraviolet stabilizers, parting agents, plasticizers, and inorganic fillers (e.g., zinc oxide, barium sulfate, titanium dioxide).

The outermost cover layer has a thickness which is at least 0.5 mm but not more than 2.0 mm, preferably at least 0.5 mm but not more than 1.5 mm, and more preferably at least 0.6 mm but not more than 1.3 mm. Moreover, the outermost cover layer has a hardness (material hardness) which, expressed as the Shore D hardness, is in a range of from 35 to 60, preferably 40 to 60, and more preferably 42 to 58. Setting the cover thickness and Shore D hardness outside of these ranges will worsen the feel of the ball on impact and the spin performance, and thus make it impossible to achieve the intended effects of the invention.

Next, the intermediate layer disposed between the above core and outermost cover layer is described.

The intermediate layer has a thickness of at least 0.5 mm but not more than 2.5 mm, preferably at least 0.8 mm but not more than 2.2 mm, and more preferably at least 1.5 mm but not more than 2.0 m. Outside of this range, the balance between the spin performance and initial velocity of the ball will be poor, resulting in a decrease in the flight performance.

The surface hardness of the intermediate layer, i.e., the Shore D hardness at the surface of the sphere composed of the core enclosed by the intermediate layer, while not subject to any particular limitation, is preferably at least 60 but not more than 80, more preferably at least 63 but not more than 77, and even more preferably at least 67 but not more than 73. At a hardness lower than the above range, the ball may take on too much spin on full shots, and may therefore not travel as far as desired. Moreover, the feel on impact may be too soft. On the other hand, at a hardness greater than the above range, the spin rate may decrease, making the ball more difficult to control, the feel of the ball may become too hard, and the durability of the ball may worsen. As used herein, "surface hardness of the intermediate layer" refers to the hardness at the surface of the sphere obtained by covering the core with the intermediate layer material, and is determined by such factors as the hardness of the underlying core and the thickness and hardness of the intermediate layer. The surface hardness of the intermediate layer differs from the hardness of the intermediate layer material itself. Also, the surface of the intermediate layer must be harder than the surface of the outermost layer.

In the practice of the invention, it is critical for the intermediate layer material to be composed primarily of a resin material obtained by blending together (I) a sodium ion neutralization product of an olefin-unsaturated carboxylic acid random copolymer with (II) a magnesium ion neutralization product of an olefin-unsaturated carboxylic acid random copolymer. The impact resistance of an ionomer is generally determined by such factors as the cationic species and the resin hardness. In the material employed in the present invention, because it is known that using the sodium ion neutralization product of a random copolymer in combination with the magnesium ion neutralization product of a random copolymer enables the impact resistance and durability of the resulting golf ball to be improved to a greater extent than using such a sodium ion neutralization product by itself, above materials (I) and (II) are used in combination.

It is possible here to additionally blend another resin material, such as a random terpolymer, together with above resin materials (I) and (II). The above terpolymer may be suitably admixed within a range that allows the objects of the invention to be attained, such as a range of about 0 to 5 parts by weight per 100 parts by weight of the base resin.

It is preferable to use an α-olefin as the olefin in above component (I) or component (II). Illustrative examples of α-olefins include ethylene, propylene and 1-butene. Of these, ethylene is especially preferred. These olefins may be used in combinations of two or more thereof.

The unsaturated carboxylic acid in component (I) or component (II) is preferably an α,β-unsaturated carboxylic acid having from 3 to 8 carbons. Illustrative examples of α,β-unsaturated carboxylic acids having 3 to 8 carbons include acrylic acid, methacrylic acid, ethacrylic acid, itaconic acid, maleic acid and fumaric acid. Of these, acrylic acid and methacrylic acid are preferred. These unsaturated carboxylic acids may be used in combinations of two or more thereof.

The unsaturated carboxylic acid content in these copolymers is preferably from 5 to 20 wt %, both for component (I) and component (II). If the unsaturated carboxylic acid content is too low, the intermediate material may have a lower rigidity and resilience, possibly diminishing the flight performance of the golf ball. On the other hand, if the unsaturated carboxylic acid content is too high, the intermediate layer may lack sufficient softness.

When component (I) and component (II) are used in admixture, the mixing ratio therebetween by weight, expressed as (I)/(II), is preferably from 20/80 to 80/20, and more preferably from 25/75 to 75/25.

The ionomer resin used in the invention may be a commercial product, illustrative examples of which include Surlyn (produced by E.I. DuPont de Nemours & Co.) and Himilan (produced by DuPont-Mitsui Polychemicals Co., Ltd.).

The intermediate layer material has a Shore D hardness of at least 55 but not more than 70, and preferably at least 58 but not more than 65.

The golf ball of the invention can be manufactured using an ordinary process, such as a known injection molding process, to form on top of one another the respective layers described above—the core, intermediate layer, and cover. For example, a molded and vulcanized material composed primarily of rubber may be placed as the core within a particular injection-molding mold, following which the intermediate layer material may be injection-molded over the core to give an intermediate spherical body. The spherical body may then be placed within another injection-molding mold and the cover material injection-molded over the spherical body to give a multi-piece golf ball. Alternatively, the cover may be formed as a layer over the intermediate spherical body by, for example, placing two half-cups, molded beforehand as hemispherical shells, around the intermediate spherical body so as to encase it, then molding under applied heat and pressure.

Numerous dimples may be formed on the surface of the cover. The dimples arranged on the cover surface, while not subject to any particular limitation, number preferably at least 250 but not more than 500, more preferably at least 280 but not more than 360, and even more preferably at least 300 but not more than 350. If the number of dimples is higher than the above range, the ball will tend to have a low trajectory, which may shorten the distance of travel. On the other hand, if the number of dimples is too small, the ball will tend to have a high trajectory, as a result of which an increased distance may not be achieved.

Any one or combination of two or more dimple shapes, including circular shapes, various polygonal shapes, dewdrop shapes and oval shapes, may be suitably used. If circular dimples are used, the diameter of the dimples may be set to at least about 2.5 mm but not more than about 6.5 mm, and the depth may be set to at least 0.08 mm but not more than 0.30 mm.

To fully manifest the aerodynamic characteristics of the dimples, the dimple coverage on the spherical surface of the golf ball, which is the sum of the individual dimple surface areas, each defined by the border of the flat plane circumscribed by the edge of the dimple, expressed as a ratio (SR) with respect to the spherical surface area of the ball were it to be free of dimples, is preferably at least 60% but not more than 90%. Also, to optimize the trajectory of the ball, the value V0 obtained by dividing the spatial volume of each dimple below the flat plane circumscribed by the edge of that dimple by the volume of a cylinder whose base is the flat plane and whose height is the maximum depth of the dimple from the cylinder base is preferably at least 0.35 but not more than 0.80. In addition, the VR value, which is the sum of the volumes of individual dimples formed below flat planes circumscribed by the dimple edges, as a percentage of the volume of the ball sphere were it to have no dimples thereon, is preferably at least 0.6% but not more than 1.0%. Outside of the above ranges for these values, the ball may assume a trajectory that is not conducive to achieving a good distance, as a result of which the ball may fail to travel a sufficient distance when played.

The golf ball of the invention may be manufactured so as to conform with the Rules of Golf for competitive play. That is, it may be produced to a ball diameter which is of a size that will not pass through a ring having an inside diameter of 42.672 mm, but is not more than 42.80 mm, and to a weight of generally from 45.0 to 45.93 g.

The golf ball of the invention uses as the core a material of exceptional resilience that has been molded under heat from a rubber composition, as a result of which the ball as a whole has an excellent rebound. Moreover, the golf ball of the invention has a flight performance and controllability acceptable for use by professionals and skilled amateur golfers, and also has a good feel on impact and an excellent scuff resistance.

EXAMPLES

The following Examples and Comparative Examples are provided by way of illustration and not by way of limitation.

Examples 1 to 3, Comparative Examples 1 to 6

Using a core material composed primarily of the polybutadiene shown in Table 1 below, a solid core having a diameter of 37.3 mm, a weight of 31.9 g, and a deflection adjusted to 3.8 mm or 3.9 mm was produced. The deflection was the measured amount of deformation by the core when compressed under a final load of 1,275 N (130 kgf) from an initial load of 98 N (10 kgf).

TABLE 1

| | | Core No. | | | |
|---|---|---|---|---|---|
| | | No. 1 | No. 2 | No. 3 | No. 4 |
| Formulation (pbw) | Polybutadiene EC140 | 100 | | | |
| | Polybutadiene BR51 | | 100 | | |
| | Polybutadiene BR60 | | | 100 | |
| | Polybutadiene BR01 | | | | 100 |
| | Peroxide | 1 | 1 | 1 | 1 |
| | Zinc oxide | 21.3 | 21.3 | 21.3 | 21.3 |
| | Antioxidant | 0.2 | 0.2 | 0.2 | 0.2 |
| | Zinc diacrylate | 32 | 32 | 32 | 32 |
| | Zinc salt of pentachlorothiophenol | 1.5 | 1.5 | 1.5 | 1.5 |
| | Zinc stearate | 5 | 5 | 5 | 5 |
| Properties | Diameter (mm) | 37.3 | 37.3 | 37.3 | 37.3 |
| | Weight (g) | 31.9 | 31.8 | 31.9 | 31.9 |
| | Deflection (mm) | 3.8 | 3.8 | 3.8 | 3.9 |

Details of the above formulation are provided below.

Polybutadiene rubber:

EC140 (trade name), available from Firestone Polymers. Polymerized with a neodymium catalyst. Mooney viscosity, 43; $T_{80}$ value, 2.3.

Polybutadiene rubber:

BR51 (trade name), available from JSR Corporation. Polymerized with a neodymium catalyst. Mooney viscosity, 39; $T_{80}$ value, 5.0.

Polybutadiene rubber:

BR60 (trade name), available from Polimeri Srl. Polymerized with a neodymium catalyst. Mooney viscosity, 57; $T_{80}$ value, 4.6.

Polybutadiene rubber:

BR01 (trade name), available from JSR Corporation. Polymerized with a nickel catalyst. Mooney viscosity, 48; $T_{80}$ value, 8.4.

Peroxide: Dicumyl peroxide, available from NOF Corporation under the trade name Percumyl D.

Zinc oxide: Available from Sakai Chemical Industry Co., Ltd. under the trade name Sanshu Sanka Aen. Average particle size, 0.6 μm (air permeametry).

Antioxidant: Available from Ouchi Shinko Chemical Industry Co., Ltd. under the trade name Nocrac NS-6.

Zinc diacrylate: Available from Nippon Shokubai Co., Ltd.

Zinc stearate: Available from NOF Corporation under the trade name Zinc Stearate G.

Next, an intermediate layer material of the composition shown in Table 3 (examples of the invention) or Table 4 (comparative examples) was injection-molded to a thickness of 1.67 mm in a mold within which the above solid core (cores No. 1 to No. 4 in Table 1) had been placed. The sphere composed of the core encased within the intermediate layer was then placed in a mold, and the outermost cover layer shown in Table 2 was injection molded over the sphere to a thickness of 1.01 mm, thereby producing in the respective examples a three-piece solid golf ball having a diameter of 42.7 mm. The intermediate layer material was prepared by mixture in a co-rotating twin-screw extruder (screw diameter, 32 mm; L/D=30; main motor output, 7.5 kw; with vacuum vent port) at 200° C.

TABLE 2

| | | Amount included (pbw) |
|---|---|---|
| Formulation | T-8295 | 50 |
| | T-8290 | 50 |

TABLE 2-continued

| | Amount included (pbw) |
|---|---|
| Titanium oxide | 3.8 |
| Polyethylene wax | 1.4 |
| Isocyanate compound | 18 |
| Specific gravity | 1.01 |
| Weight (g) | 5.78 |
| Material hardness (Shore D hardness) | 48 |

Details concerning the above formulation are given below.

T-8290, T-8295: MDI-PTMG type thermoplastic polyurethanes produced by DIC Bayer Polymer under the trademark designation Pandex.

Titanium oxide: Produced by Ishihara Sangyo Kaisha, Ltd. under the trade name Tipaque R550.

Polyethylene wax: Produced by Sanyo Chemical Industries, Ltd. under the trade name Sanwax 161P.

TMP (trade name): A trimethylolpropane produced by Mitsubishi Gas Chemical Co., Ltd.

TABLE 3

| | | Example | | |
|---|---|---|---|---|
| | | 1 | 2 | 3 |
| Core | Type | No. 1 | No. 1 | No. 1 |
| Intermediate layer resin formulation | H1706 (Zn ion type) | | | |
| | H1605 (Na ion type) | 30 | 50 | 70 |
| | AM7311 (Mg ion type) | 70 | 50 | 30 |
| | TMP | 1.1 | 1.1 | 1.1 |
| Resin properties | MFR (190° C., g/10 min) | 1.3 | 1.7 | 1.5 |
| | Specific gravity | 0.94 | 0.94 | 0.95 |
| | Shore D hardness | 65 | 65 | 66 |
| Ball properties | Diameter (mm) | 42.7 | 42.7 | 42.7 |
| | Weight (g) | 45.6 | 45.6 | 45.6 |
| | Deflection hardness (mm) | 2.6 | 2.5 | 2.5 |
| | Initial velocity (m/s) | 77.2 | 77.3 | 77.3 |
| | Scuff resistance | 4.4 | 4.4 | 4.3 |
| | Feel on impact | good | good | good |

Note:
Numbers for the intermediate layer resin formulations indicate parts by weight.

TABLE 4

| | | Comparative example | | | | | |
|---|---|---|---|---|---|---|---|
| | | 1 | 2 | 3 | 4 | 5 | 6 |
| Core | Type | No. 1 | No. 1 | No. 2 | No. 3 | No. 4 | No. 4 |
| Intermediate layer resin formulation | H1706 (Zn ion type) | 100 | | | | | 100 |
| | H1605 (Na ion type) | | 100 | 50 | 50 | 50 | |
| | AM7311 (Mg ion type) | | | 50 | 50 | 50 | |
| | TMP | 1.1 | 1.1 | 1.1 | 1.1 | 1.1 | 1.1 |
| Resin properties | MFR (190° C., g/10 min) | 0.7 | 2.0 | 1.7 | 1.7 | 1.7 | 0.7 |
| | Specific gravity | 0.96 | 0.95 | 0.94 | 0.94 | 0.94 | 0.96 |
| | Shore D hardness | 62 | 64 | 65 | 65 | 65 | 62 |
| Ball properties | Diameter (mm) | 42.7 | 42.7 | 42.7 | 42.7 | 42.7 | 42.7 |
| | Weight (g) | 45.6 | 45.6 | 45.6 | 45.6 | 45.6 | 45.6 |
| | Deflection hardness (mm) | 2.7 | 2.6 | 2.5 | 2.5 | 2.6 | 2.8 |
| | Initial velocity (m/s) | 76.8 | 77.1 | 77.0 | 77.0 | 76.8 | 76.4 |
| | Scuff resistance | 4.6 | 4.1 | 4.4 | 4.4 | 4.4 | 4.6 |
| | Feel on impact | NG | NG | good | good | good | NG |

Note:
Numbers for the intermediate layer resin formulations indicate parts by weight.

Isocyanate Compound:

Crossnate EM30 (trade name), an isocyanate masterbatch which is produced by Dainichi Seika Colour & Chemicals Mfg. Co., Ltd., contains 30% of 4,4'-diphenylmethane diisocyanate (measured concentration of amine reverse-titrated isocyanate according to JIS-K1556, 5 to 10%), and in which the masterbatch base resin is a polyester elastomer (Hytrel 4001, produced by DuPont-Toray Co., Ltd.). The isocyanate compound was mixed at the time of injection.

Details concerning the formulated ingredients in Tables 3 and 4 below are as follows.

Himilan 1706 (trade name):

An ionomer resin which is a zinc ion-neutralized ethylene-methacrylic acid random copolymer produced by DuPont-Mitsui Polychemicals Co., Ltd.

Himilan 1605 (trade name):

An ionomer resin which is a sodium ion-neutralized ethylene-methacrylic acid random copolymer produced by DuPont-Mitsui Polychemicals Co., Ltd.

AM7311 (trade name):

An ionomer resin which is a magnesium ion-neutralized ethylene-methacrylic acid random copolymer produced by DuPont-Mitsui Polychemicals Co., Ltd.

[Evaluation of Intermediate Layer/Cover Material Properties]

Melt Mass Flow Rate

The melt mass flow rate of a material measured in accordance with JIS-K6760 (test temperature, 190° C.; test load, 21 N (2.16 kgf)).

Resin Hardness

The shore D hardness measured in accordance with ASTM D-2240 is shown.

[Evaluation of Ball Properties]

Ball Deflection (mm)

The deformation (mm) of the golf ball when compressed under a final load of 1,275 N (130 kgf) from an initial load state of 98 N (10 kgf) was determined.

Ball Initial Velocity (m/s)

The initial velocity (m/s) was measured using an initial velocity measuring apparatus of the same type as that of the official golf ball regulating-body—R&A (USGA), and in accordance with R&A (USGA) rules.

Scuff Resistance

A non-plated X-WEDGE 03 (loft, 52°) manufactured by Bridgestone Sports Co., Ltd. was set in a swing robot, and the ball was hit at a head speed of 33 m/s with the club face open about 30° from square. The surface state of the ball was then visually examined by three golfers having handicaps of 10 or less, and rated according to the following criteria. The average of the ratings obtained for each example is shown in the table.

5: Surface of ball is either completely unchanged or bears a slight imprint from club face.
4: Surface of ball bears a clear imprint from club face, but is not frayed.
3: Surface is conspicuously frayed and scuffed.
2: Surface is frayed and cracked.
1: Some dimples have been obliterated.

Feel on Impact

Sensory evaluations were carried out with a panel of ten amateur golfers having head speeds of 35 to 40 m/s and using W#1 clubs. Ratings were based on the following criteria.

Good: At least 7 of the 10 golfers thought the ball had a good feel.
Fair: Five or six of the 10 golfers thought the ball had a good feel.
Poor: Four or fewer of the 10 golfers thought the ball had a good feel.

It is apparent from the results in Tables 3 and 4 that the golf balls obtained in Examples 1 to 3 according to the invention had an excellent rebound, scuff resistance and feel. By contrast, the balls obtained in Comparative Examples 1 to 6 showed no improvement in one or more of the following: initial velocity, feel and scuff resistance.

The invention claimed is:

1. A golf ball comprising a core, an outermost cover layer and an intermediate layer therebetween, wherein the core is made of a material obtained by molding under heat a rubber composition comprising (a) a base rubber containing polybutadiene having a stress relaxation time ($T_{80}$), defined as the time in seconds from the moment when rotation is stopped immediately after measurement of the $ML_{1+4}$ (100° C.) value (the Mooney viscosity measured at 100° C. in accordance with ASTM D-1646-96) that is required for the $ML_{1+4}$ value to decrease 80%, of 3.5 or less, (b) an unsaturated carboxylic acid and/or a metal salt thereof, and (c) an organic peroxide; the intermediate layer has a thickness of from 0.5 to 2.5 mm and is made primarily of a resin material obtained by blending together (I) a sodium ion neutralization product of an olefin-unsaturated carboxylic acid random copolymer with (II) a magnesium ion neutralization product of an olefin-unsaturated carboxylic acid random copolymer and having a Shore D hardness of from 55 to 70; and the outermost cover layer has a thickness of from 0.5 to 2.0 mm and is made primarily of a non-ionomeric resin material having a Shore D hardness of from 35 to 60.

2. The golf ball of claim 1, wherein the rubber composition further comprises (d) an organosulfur compound.

3. The golf ball of claim 1, wherein the polybutadiene having a stress relaxation time ($T_{80}$) of 3.5 or less accounts for at least 40 wt % of the base rubber.

4. The golf ball of claim 1, wherein the polybutadiene having a stress relaxation time ($T_{80}$) of 3.5 or less is a polybutadiene prepared using a rare-earth catalyst.

5. The golf ball of claim 1, wherein the polybutadiene having a stress relaxation time ($T_{80}$) of 3.5 or less is a polybutadiene prepared by polymerization using a rare-earth catalyst, followed by terminal modification.

6. The golf ball of claim 1, wherein the intermediate layer-forming material contains material (I) and material (II) in a mixing ratio by weight of from 20/80 to 80/20.

7. The golf ball of claim 1, wherein the non-ionomeric resin material in the outermost cover layer is a thermoplastic polyurethane elastomer.

* * * * *